US005094216A

United States Patent [19]

Miyaki et al.

[11] Patent Number: 5,094,216

[45] Date of Patent: Mar. 10, 1992

[54] VARIABLE DISCHARGE HIGH PRESSURE PUMP

[75] Inventors: Masahiko Miyaki, Obu; Hiroyasu Kanamori, Anjo; Yoshihisa Yamamoto, Kariya; Hiroyuki Kano; Mikio Kumano, both of Anjo; Shigeyuki Kondoh, Aichi, all of Japan

[73] Assignee: Nippondenso Co., Ltd., Kariya, Japan

[21] Appl. No.: 462,870

[22] Filed: Jan. 8, 1990

Related U.S. Application Data

[63] Continuation of Ser. No. 244,823, Sep. 15, 1988, abandoned.

[30] Foreign Application Priority Data

Sep. 16, 1987 [JP] Japan ..... 62-231349
Oct. 12, 1987 [JP] Japan ..... 62-256826
Oct. 12, 1987 [JP] Japan ..... 62-256827

[51] Int. Cl.[5] ..... F02M 37/04

[52] U.S. Cl. ..... 123/506; 123/456; 123/496

[58] Field of Search ..... 123/456, 506, 445, 446, 123/458, 496, 447

[56] References Cited

U.S. PATENT DOCUMENTS 3,851,635 12/1974 Murtin .
4,217,862 8/1980 Fort .
4,385,614 5/1983 Eheim ..... 123/506
4,404,846 9/1983 Yamauchi et al. .
4,491,111 1/1985 Eheim ..... 123/506
4,545,352 10/1985 Jourde et al. ..... 123/467
4,546,749 10/1985 Igashira et al. .
4,554,903 11/1985 Straubel et al. .
4,580,480 5/1986 Kobayashi ..... 123/506
4,583,510 4/1986 Schechter .
4,586,656 5/1986 Wich .
4,627,403 12/1986 Matsumura .
4,642,773 2/1987 Miyaki et al. .
4,719,889 1/1988 Amann et al. .
4,765,302 8/1988 Ikeuchi ..... 123/506
4,777,921 10/1988 Miyaki ..... 123/456
4,784,101 11/1988 Iwanaga et al. .

FOREIGN PATENT DOCUMENTS 0133203 2/1985 European Pat. Off. .
0243871 11/1987 European Pat. Off. .
88115243 1/1990 European Pat. Off. .
57-99238 6/1982 Japan .
2132706 7/1984 United Kingdom ..... 123/506
2165895A 4/1986 United Kingdom .

OTHER PUBLICATIONS

European Search Report, No. 0133203, date search completed 11-11-86.
Fujisawa et al., "Diesel Fuel Injection", pp. 87-92 with English Translation.
Burman et al., "Fuel Injection and Controls for Internal Combustion Engines", Jul. 10, 1964, pp. 67-70.

*Primary Examiner*—Carl Stuart Miller
*Attorney, Agent, or Firm*—Cushman, Darby & Cushman

[57] ABSTRACT

A variable discharge high pressure pump for pumping a fuel into a common rail of a common rail type fuel injection system has a plunger reciprocable in a cylinder bore and a pumping chamber defined between and end face of the plunger and the inner peripheral surface of the cylinder bore. A solenoid valve has a valve member movable into an open position in which the valve member is moved out of engagement with an associated value seat into the pumping chamber when the solenoid valve is deenergized. When the solenoid valve is energized, the valve member is moved into a closed position in which the fuel pressure in the pumping chamber acts on the valve member to urge the same into engagement with the valve seat. The plunger is of a simple cylindrical structure free from any lead formed therein.

22 Claims, 12 Drawing Sheets

FIG. 5(A) CYLINDER JUDGEMENT

FIG. 5(B) CAM ANGLE

FIG. 5(C) LIFT 12a OF CAM 13a

FIG. 5(D) CONTROLL SIGNAL FOR SOLENOID VALVE 30a

FIG. 5(E) LIFT 12b OF CAM 13b

FIG. 5(F) CONTROLL SIGNAL FOR SOLENOID VALVE 30b

FIG. 5(G) LIFT 12c OF CAM 13c

FIG. 5(H) CONTROLL SIGNAL FOR SOLENOID VALVE 30c

FIG. 6(A) CYLINDER JUDGEMENT

FIG. 6(B) CAM ANGLE

FIG. 6(C) CONTROL SIGNAL FOR SOLENOID VALVE 30

FIG. 6(D) VALVE POSITION

FIG. 6(E) LIFT OF CAM 13

SL: DISCHARGE STROKE WHEN TFF IS TFO
SN: DISCHARGE STROKE WHEN TFF IS TFO
SH: DISCHARGE STROKE WHEN TFF IS TFO

VARIABLE DISCHARGE HIGH PRESSURE PUMP

This is a continuation of Application No. 07/244,823, filed Sept. 15, 1988, which was abandoned upon the filing hereof.

BACKGROUND OF THE INVENTION

The present invention relates to a variable discharge high pressure pump suitable for pumping a fuel at a high pressure into a common rail of a common rail type fuel injection system which is operative to inject the high pressure fuel from the common rail through fuel injectors into cylinders of a Diesel engine.

DESCRIPTION OF THE PRIOR ART

A fuel injection system of the type that includes a high pressure tubing which forms a pressure accumulator referred to as "common rail" was recently devised as a fuel injection system for Diesel engines, as disclosed in Japanese Unexamined Patent Publication No. 59-165858 (corres. to U.S. Pat. No. 4,545,352). The fuel injection system includes a common rail which is supplied with a fuel at a high pressure by a high pressure supply pump. The system also includes solenoid valves openable to allow the high pressure fuel to flow from the common rail through injectors into engine cylinders.

In the fuel injection system of the type referred to above, it is required to maintain the common rail pressure (corresponding to the injection pressure) at a highly accurately controlled constant level. The supply pump, therefore, is required to feed, in each cycle of the engine operation, a quantity of fuel equal to the consumed or injected amount of fuel. Accordingly, the high pressure supply pump should be a pressure accumulation pump, the discharge of which can be electro-controlled each time either in dependence on the engine load or speed, or in accordance with predetermined desired demand injection pressure.

Moreover, unlike the in-line fuel injection pump operative to pump a fuel directly into respective engine cylinders, the high pressure supply pump is required to maintain the common rail at a high pressure throughout all the cycles of the engine operation. Accordingly, the high pressure supply pressure must be constructed to minimize the leakage of the high pressure fuel within the pump, i.e., the leakage from a high pressure pumping chamber into a low pressure section of the pump, in order to reduce the torque of the engine needed to drive the high pressure supply pump.

SUMMARY OF THE INVENTION

It is an object of the present invention to provide a variable discharge high pressure pump which can be electro-controlled to vary the discharge each time in dependence on the engine operation condition or in accordance with the amount of fuel consumed from the common rail and which is so constructed as to reduce the leakage of the fuel from the high pressure pumping chamber into a low pressure section of the pump to thereby maintain the common rail pressure at a high pressure level.

The variable discharge high pressure pump according to the present invention is for use with a common rail type fuel injection system including a common rail for accumulating a fuel pressure therein. The pump includes a cylinder formed therein with at least one cylinder bore and a plunger reciprocally received in the cylinder bore and having an end face cooperating with an inner peripheral surface of the cylinder bore to define a pumping chamber. A forward stroking movement of the plunger into the pumping chamber pressurizes a quantity of a fuel therein and discharges the thus pressurized fuel from the pumping chamber into the common rail. A solenoid valve includes a valve member associated with the pumping chamber and defines a low pressure passage adapted to be communicated with the pumping chamber. The valve member is opened outwardly from the solenoid valve into the pumping chamber when the solenoid valve is deenergized to allow the pumping chamber to be communicated with the pumping chamber. The valve member is closed when the solenoid valve is energized to interrupt the communication between the pumping chamber and the low pressure passage so that the pressurization of the fuel in the pumping chamber by said plunger is commenced. The valve member is disposed to receive from the pressurized fuel in the pumping chamber a force which urges the valve member toward the closed position. The plunger is of a generally column-like structure free from any lead formed therein.

With the structure and arrangement of the pump set forth above, when a solenoid valve is electrically energized, its valve member blocks an associated low pressure passage to commence the pressurization in the pumping chamber of an associated plunger. Thus, the timing of the electrical energization of the solenoid valve can be controlled such that the discharge of fuel from the pump into the common rail is controlled each time.

In addition, because the valve member of each solenoid valve is of the type that is forced by the pressure in the pumping chamber towards a closed position, when the valve member has blocked the low pressure passage upon electrical energization of the solenoid valve, the valve member is further urged into a further intimate sealing engagement with an associated valve seat by the high fuel pressure in the pumping chamber with a resultant improvement in the prevention of the leakage of the fuel from the pumping chamber.

Moreover, because the plunger slidably mounted in the cylinder is of a simple column-like configuration free from any lead and because the valve member of the solenoid valve exhibits a superior sealing characteristic during each pressurizing stroke of the plunger, the fuel in the pumping chamber defined by the inner peripheral surface of the cylinder and an end face of the plunger can be pressurized to a high pressure level and the leakage of the high pressure fuel from the pumping chamber to a low pressure section of the pump can be greatly decreased to assure that the common rail is maintained at a high pressure level.

The above and other objects, features and advantages of the invention will be made more apparent by the following description of preferred embodiments with reference to the accompanying drawings.

DESCRIPTION OF PREFERRED EMBODIMENTS

Figure 3:
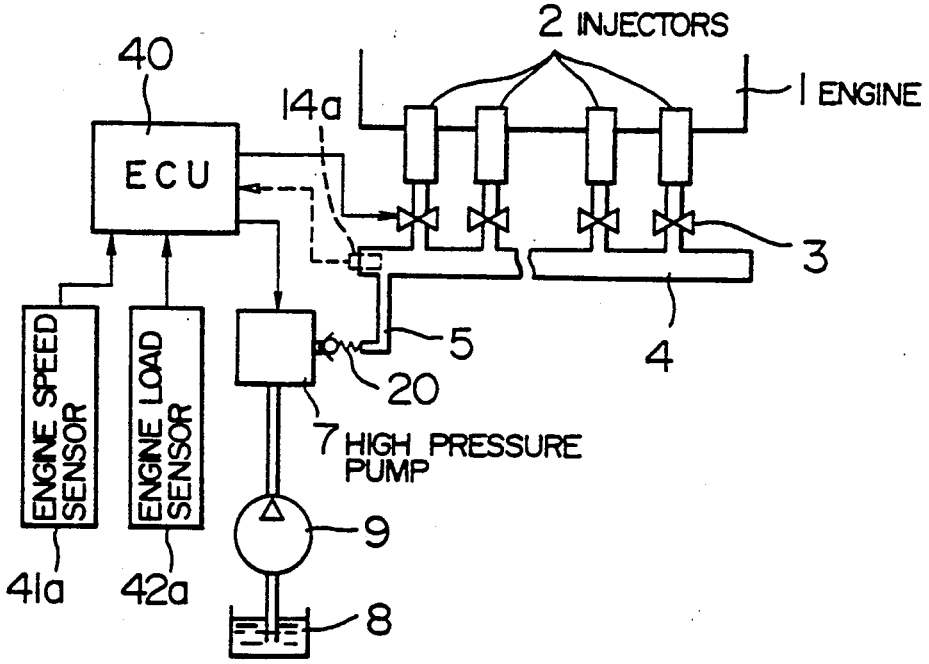
FIG. 3 is a diagrammatic illustration of the variable discharge high pressure pump applied to a common rail type fuel injection system.
Figure 4:
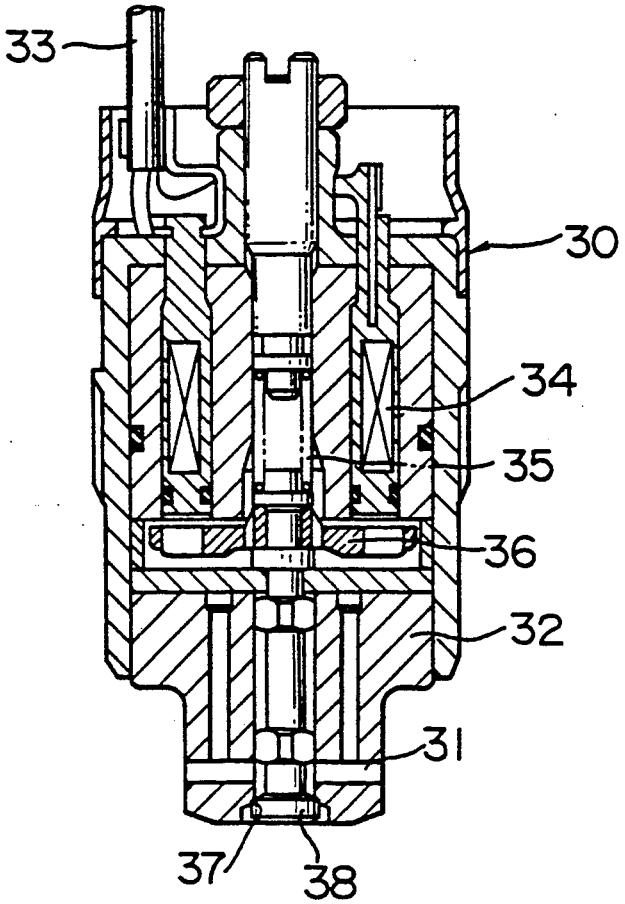
FIG. 4 is a sectional view of a solenoid valve incorporated in the variable discharge high pressure pump shown in FIG. 1.

Referring to FIG. 3 of the drawings, an internal combustion engine 1 has cylinders defining therein combustion chambers with which injectors 2 are associated. Solenoid valves 3 are provided for respective injectors 2 and have open and closed positions to control the injections of fuel through the injectors. The injectors 2 are all connected to a high pressure tube or so-called "common rail" 4 which forms a pressure accumulating means, so that, when the solenoid valves 3 are in the open positions, the fuel is allowed to flow from the common rail 4 through the injectors 2 into the engine combustion chambers. It is, therefore, necessary that the fuel in the common rail 4 be always kept at a predetermined high pressure level corresponding to the fuel injection pressure. For this purpose, the common rail 4 is connected through a fuel supply line 5 and a discharge valve 20 to a high pressure fuel supply pump which, in the embodiment of the invention, is in the form of a variable discharge high pressure pump 7. This high pressure pump 7 is operative to pressurize to the high pressure level the fuel fed from a fuel tank 8 by a low pressure supply pump 9 which is known per se.

The system described is controlled by an ECU 40 which receives signals such as engine speed signal and engine load signal from an engine speed sensor 41*a* and an engine load sensor 42*a*. On the basis of these signals, the ECU 40 judges the engine operating condition and emits control signals to the solenoid valves 3 such that the fuel injection timing and the amounts (duration of injections) of fuel to be injected through the injectors 2 are optimum for the engine operating condition thus judged. At the same time, the ECU 40 also emits a pump controlling signal to the high pressure pump 7 such that the injection pressure is optimum for the engine load and speed detected by the sensors 41*a* and 42*a*.

Preferably, the common rail 4 is provided with a pressure sensor 14*a* for detecting the common rail pressure and generating a signal to be fed into the ECU 40. The discharge of the high pressure pump 7 is so set that the signal produced by the pressure sensor 14*a* is of a predetermined value optimum for varing engine load and speed.

Figure 1:
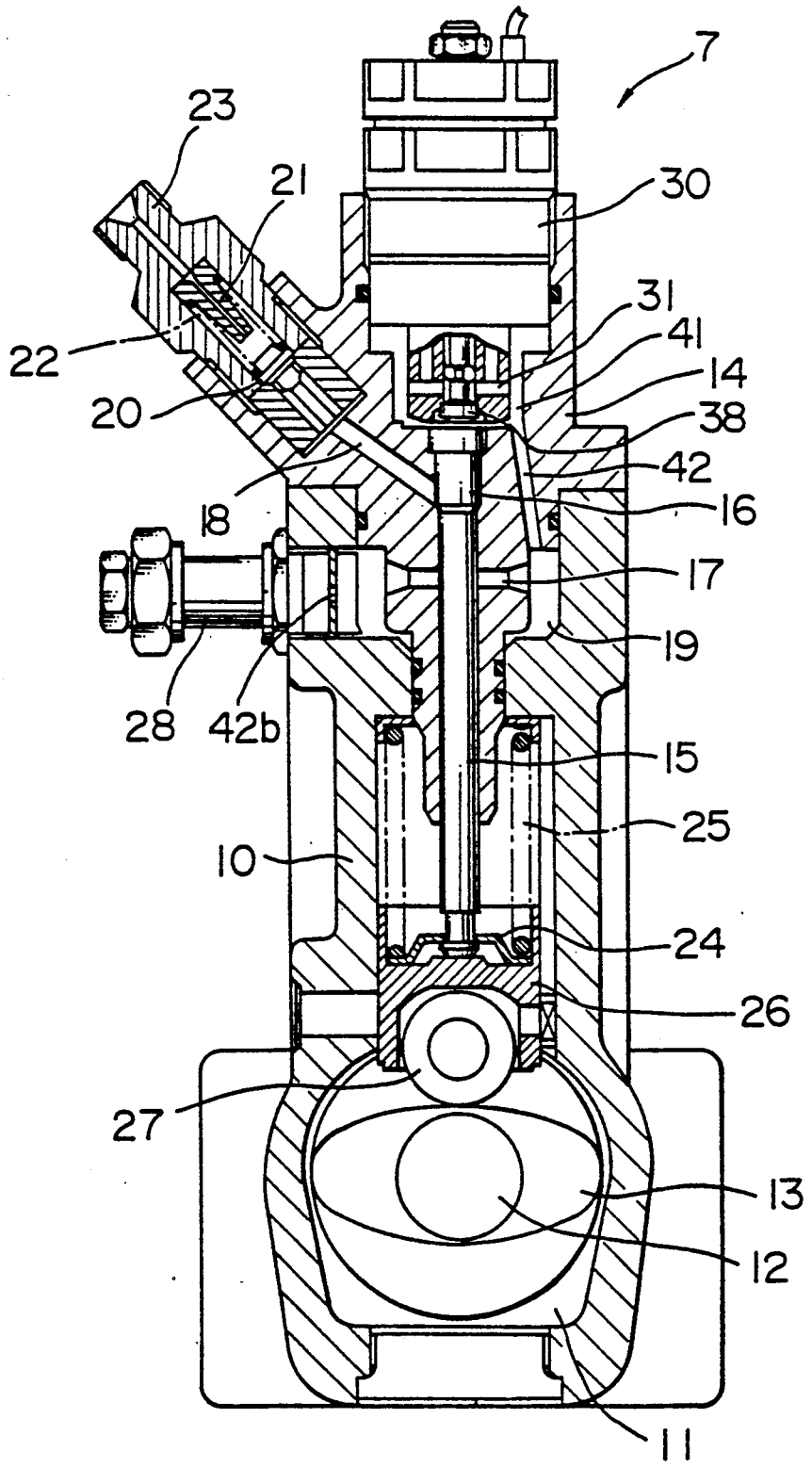
FIG. 1 is a sectional view of an embodiment of the variable discharge high pressure pump according to the present invention.

The variable discharge high pressure pump 7 of the embodiment of the invention will now be described with reference to FIGS. 1-4. Referring first to FIG. 1, the pump 7 has a pump housing 10 with a cam chamber 11 formed therein at the lower end of the housing. The cam chamber 11 accommodates a cam shaft 12 which is rotated at a speed equal to ½ of the engine speed and which is formed thereon with cams 13 each shaped to provide two lifting strokes per each rotation of the cam shaft 12. More specifically, each cam 13 is shaped to have two cam lobes. The respective cams 13 are arranged such that the phases of the cam lifts of the cams are mutually offset by 120 degrees in terms of the pump rotation, as will be seen in FIG. 2.

The pump housing 10 has an upper end connected to a cylinder 14 which defines therein cylinder bores in which plungers 15 are reciprocally and slidably received. Unlike the plungers of the conventional in-line injection pump which are formed with notches in the outer peripheral surfaces of the plungers, the plungers 15 are each of a simple cylindrical shape free from any lead or the like. Each plunger 15 has an upper end face which cooperates with the inner peripheral surface of an associated cylinder bore to define a pumping chamber 16. The cylinder 14 is formed therein with a feed hole 17 communicated with one of the pumping chambers 16 and with a discharge port 18 communicated with the pumping chamber 16 and disposed above the feed hole 17, as viewed in FIG. 1. Each feed hole 17 is also communicated with a fuel chamber 19 which is defined between the pump housing 10 and the cylinder 14 and supplied with a low pressure fuel from the low pressure supply pump 9 through an inlet pipe 28. A restriction orifice 42*b* is provided for the inlet pipe 28 to restrict the fuel supply to the fuel chamber 19 to a predetermined rate.

Discharge valves 20 are mounted on the cylinder 14 and associated with the pumping chambers 16, respectively. Each discharge valve 20 is communicated with one of the pumping chambers 16 through a discharge port is formed in the cylinder 14. Each discharge valve 20 includes a valve member 21 which is adapted to be moved by the pressurized fuel in the pumping chamber 16 against a return spring 22 to an open position, so that the pressurized fuel is discharged through a discharge port member 23 into the common rail 4.

The lower end of each plunger 15 is connected to a spring retainer 24 which is urged by a return spring 25 against a slide member 26 having a cam roller 27 which is in rolling contact with one of the cams 13. Therefore, when the cam shaft 12 is rotated with the cams 13 thereon, the rotation of each cam 13 moves an associated cam roller 27 and the spring retainer 26 associated therewith, so that an associated plunger 15 is reciprocally moved up and down. The stroke of each plunger 15 is determined by the cam profile of each of the cams 13. The reciprocal movement of each plunger 15 in the cylinder 14 cyclically opens and closes an associated feed hole 17. When the plunger 15 is not in the position to close the feed hole 17, the low pressure fuel is fed through the feed hole 17 into an associated pumping chamber 16.

Solenoid valves 30 are screwed into threaded holes in the top face of the cylinder 14 and disposed in alignment with the upper ends of respective plungers. As will be clearly seen in FIG. 4, each solenoid valve 30 has a body 32 formed therein with a low pressure passage 31 opened at one end to the pumping chamber 16 and communicated at the other end with a low pressure section of the pump, an armature 36 attracted upwardly, as viewed in FIG. 4, against a spring 35 by a magnetic force generated when a solenoid 34 is energized by an electric current fed through a conductor 33, and a valve member 38 of a mushroom shape movable with the armature 36 into and out of sealing engagement with a valve seat 37 in the pumping chamber 16 to open and close the low pressure passage. It will be understood that the valve member 38 is of outwardly-open type and receives the fuel pressure in the pumping chamber 16 as a force which urges the valve member 38 towards a valve-closed position. The solenoid valve is of a pre-stroke type solenoid valve and operative such that the solenoid 34 is electrically energized at a predetermined timing after the plunger 15 has closed the feed hole 17, to move the valve member 38 into sealing engagement with the valve seat 37 for thereby setting the timing of the commencement of the pressuring operation of the plunger 15. Thus, the timing of the electrical supply to the solenoid valve 30 may be controlled to vary the amount of the fuel to be discharged from the pump into the common rail 4. The low pressure passage 31 is communicated through a gallery 41 and a passage 42 with the fuel chamber 19.

In order to control the solenoid valves 30, the pump is provided with a rotary disc 51 mounted on the cam shaft 12 for rotation therewith and provided with circumferentially equally spaced projections of a number (six in the illustrated embodiment of the invention) equal to the number of the engine cylinders. The rotary disc 51 is associated with a cam angle sensor 50 formed by a conventional electromagnetic pickup disposed in opposed relationship with the path of rotational movement of the projections. A signal is produced and fed into the ECU 40. The arrangement is such that one of the projections on the rotary disc 51 is brought into closely spaced opposed relationship with the sensor 50 each time when a cam 13 is rotated substantially to its bottom dead center.

A disc 61 is mounted on the cam shaft 12 and associated with a cylinder-judgement sensor 62 having a single projection, so that the ECU 40 receives from the sensor 62 a single signal per each rotation of the pump. On the basis of the signals from the cylinder-judgement sensor 62 and the cam angle sensor 50, the ECU 40 accurately judges a specific pump plunger as being in its bottom dead center.

The principle operation of the variable discharge high pressure pump will now be described with reference to FIG. 1. When a plunger 15 is lowered to open the feed hole 17, the fuel is introduced through the opened feed hole 17 into the pumping chamber 16. Then, the plunger 15 is lifted to first close the feed hole 17 and further moves upwardly beyond the feed hole 17. At this time, however, the valve member 38 of the solenoid valve 30 is in its open position because the solenoid valve is not electrically energized at this moment. Thus, the upward movement of the plunger 15 causes the fuel in the pumping chamber 16 to spill through the low pressure passage 31, gallery 41 and the passage 42 back into the fuel chamber 19, so that the fuel is not pressurized.

During this spill flow of the fuel from the pumping chamber 16, a control pulse is fed to the solenoid valve 30, so that the valve member 38 is moved into sealing engagement with the valve seat 37 to interrupt the communication between the pumping chamber 16 and the low pressure passage 31. A further upward movement of the plunger 15 commences a pressurization of the fuel in the pumping chamber 16 until the fuel pressure in the pumping chamber 16 is raised beyond a level at which the discharge valve 20 is moved away from its valve seat against the spring 22, so that the pressurized fuel in the pumping chamber 16 flows therefrom through the discharge port 18 into the common rail 4.

Figure 5:
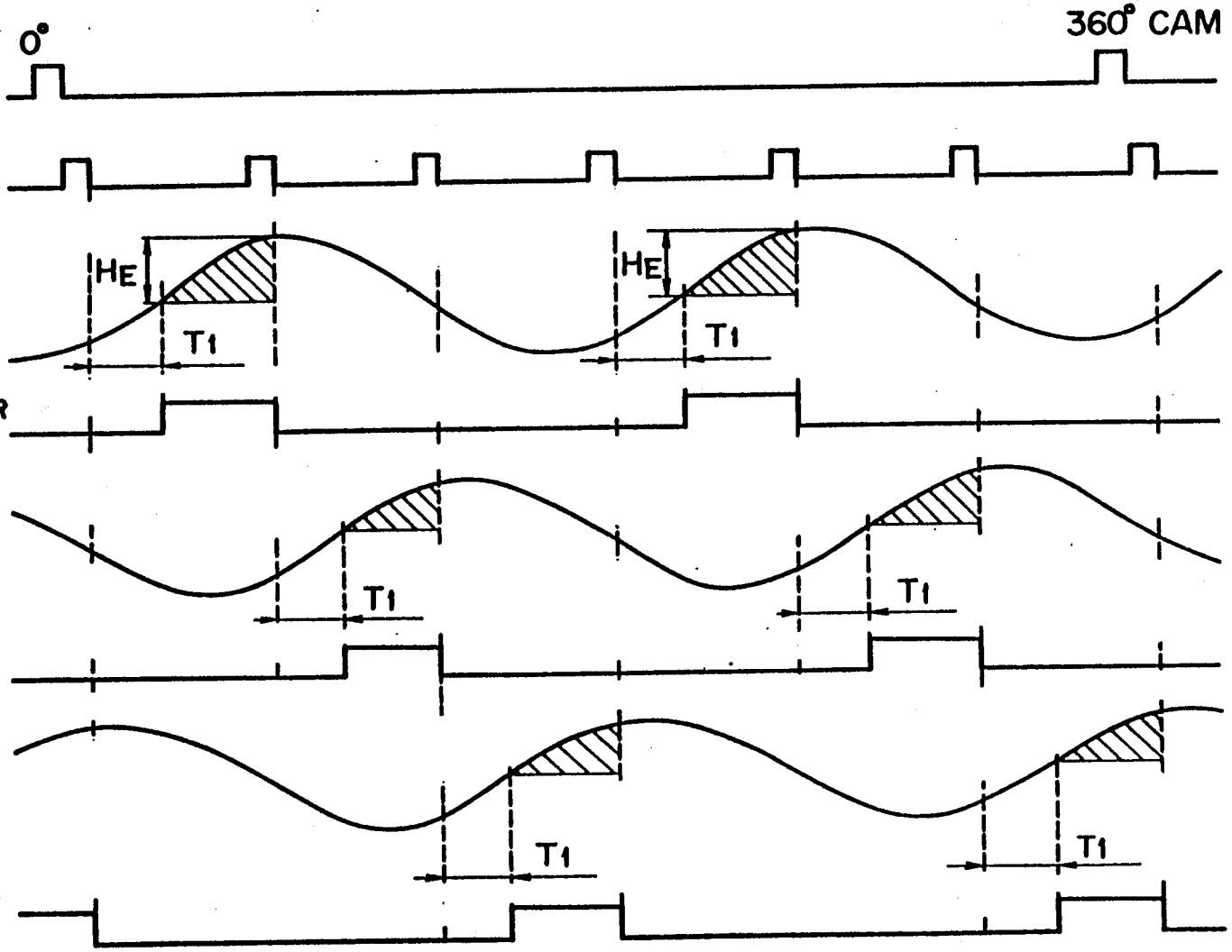
FIGS. 5(A)-5(H) are time charts diagrammatically illustrating an example of the operation of the arrangement of the system shown in FIG. 2.

Then, the operation of the common rail type fuel injection system will be described with reference to FIG. 2 and FIG. 5 which is a time chart illustrating the operation of the pump over a one complete rotation of the pump, i.e., during the rotation of the cam over 360 degrees. The lines A and B in FIG. 5 illustrate, respectively, the signal generated by the cylinder-judgement sensor 62 and the signal generated by the cam angle sensor 50. Based on these signals, the ECU 40 detects the rotational positions of specific cams of the pump. Lines C, E and G in FIG. 5 illustrate, respectively, the lifts 12*a*, 12*b* and 12*c* of the cams 13*a*, 13*b* and 13*c*. Because the pump shown in FIG. 2 has three cylinders and each of the three cams has two lobes, the pump is operative to pump the fuel six times (corresponding to six cylinders of the associated engine) per each rotation of the cam shaft 12.

Figure 2:
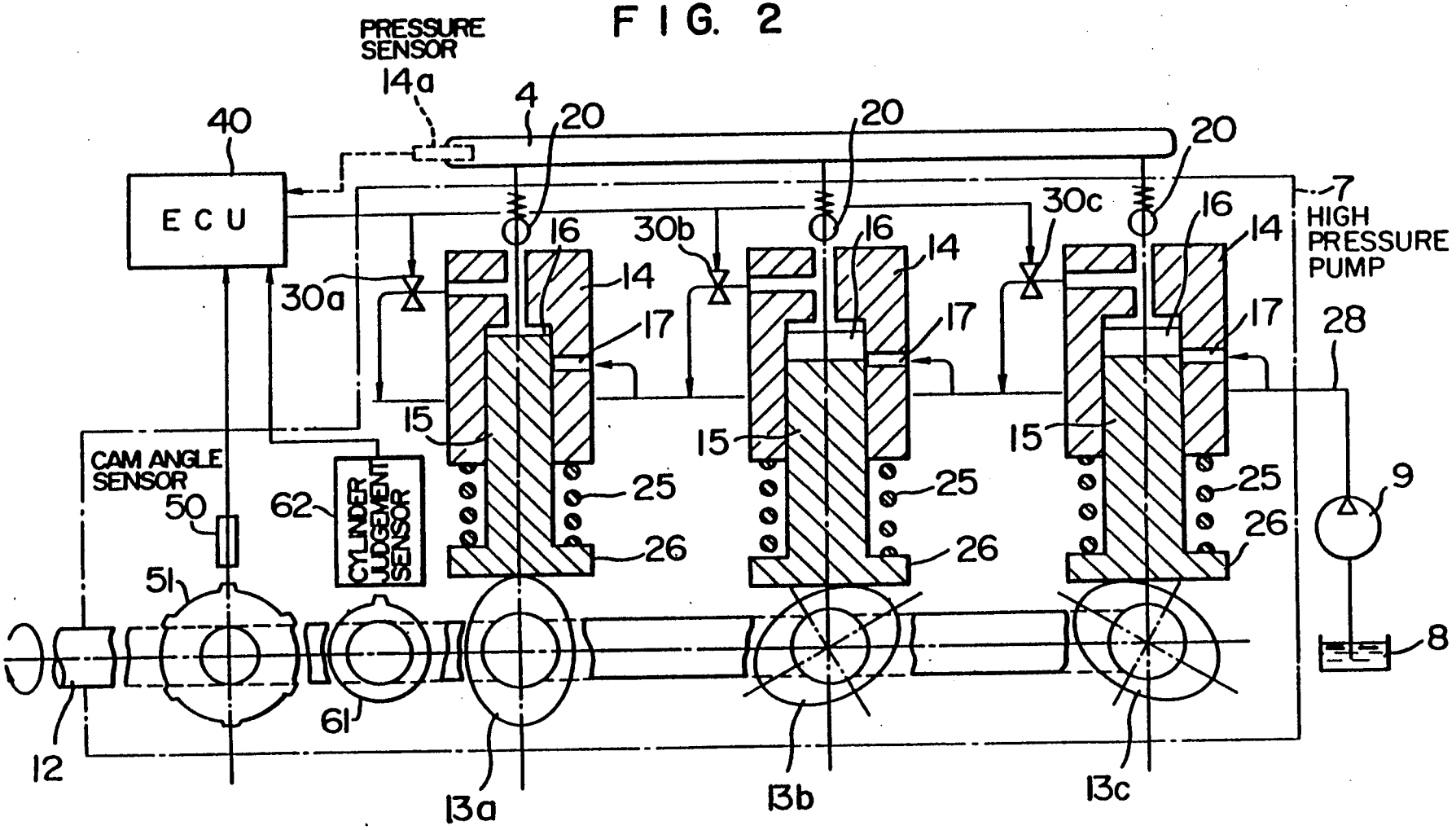
FIG. 2 is a partly sectional diagrammatic illustration of an arrangement of the variable discharge high pressure pump of the invention applied to a common rail type fuel injection system.

The lines D, F and H in FIG. 5 illustrate, respectively, control signals fed to the solenoid valves 30*a*, 30*b* and 30*c* shown in FIG. 2. It will be understood from the showing in FIG. 5 that, after the lapse of a predetermined period of time $T_1$ (or cam angle) from a cam angle signal, the ECU 40 supplies each of the solenoid valves 30*a*–30*c* with a control signal which lasts until a succeeding cam angle signal is given. Because each solenoid valve is closed during the time while the solenoid valve is supplied with a control signal, the fuel in the pumping chamber 16 is pressurized during the cam lift shown by $H_E$ (see the hatched zones shown in FIG. 5) and discharged through the discharge valve 20 into the common rail 4. The pressure of the discharged fuel is thus accumulated in the common rail 4.

It will be remembered that the valve member 38 of each solenoid valve 30 is of the structure that receives the fuel pressure in the pumping chamber 16 as a force which urges the valve member towards its closed position. Thus, when the plunger 15 is in its pumping stroke, the valve member 38 is kept in good sealing engagement with the valve seat associated therewith.

In addition, because each plunger 15 is of a simple cylindrical shape which is not provided with any lead or the like and because the valve member 38 of each solenoid valve 30 is kept in good sealing engagement with its valve seat during the pumping stroke of the associated plunger, the fuel pressurized in the pumping chamber 16 defined between the plunger 15 an the inner peripheral surface of an associated cylinder bore in the cylinder 14 is prevented from leaking from the pumping chamber 16 through such a lead or the like. This is effective to minimize the leakage of the high pressure fuel from the pumping chambers 16 of the pump to a low pressure section thereof during pumping strokes of the plungers 15.

It will also be noted that each of the cylinder bores in the cylinder 14 of the illustrated embodiment of the invention is provided with only the feed hole 17 and the discharge port 18 that are necessary to supply the pumping chamber 16 with the low pressure fuel and to discharge the pressurized fuel therefrom. This is also effective to minimize the leakage of the pressurized fuel from the pumping chambers of the pump to a low pressure section thereof.

In the operation described above, the time period $T_1$ after the lapse of which each of the solenoid valves 30*a*–30*c* is electrically energized may be controlled dependent upon the engine load detected by the load sensor 42*a*, the engine speed detected by the speed sensor 41*a* or the common rail sensor 14*a* to control the injected amount of fuel required to raise the fuel pressure in the common rail to a predetermined level and keep this fuel pressure therein. More specifically, if the time period $T_1$ is increased, the time period while each pumping chamber 16 is communicated with the associated low pressure passage 31 is increased with a resultant increase in the so-called "pre-stroke time" and, thus, with a decrease in the injected amount of fuel. On the other hand, if the time period $T_1$ is decreased, the time period while each of the pumping chambers 16 is communicated with the associated low pressure passage 31 is decreased with a resultant decrease in the pre-stroke time and, thus, with an increase in the injected amount of fuel.

Another example of the method of operating the pump according to the present invention will be described with reference to FIG. 6. The pump structure per se is unchanged.

Figure 6:
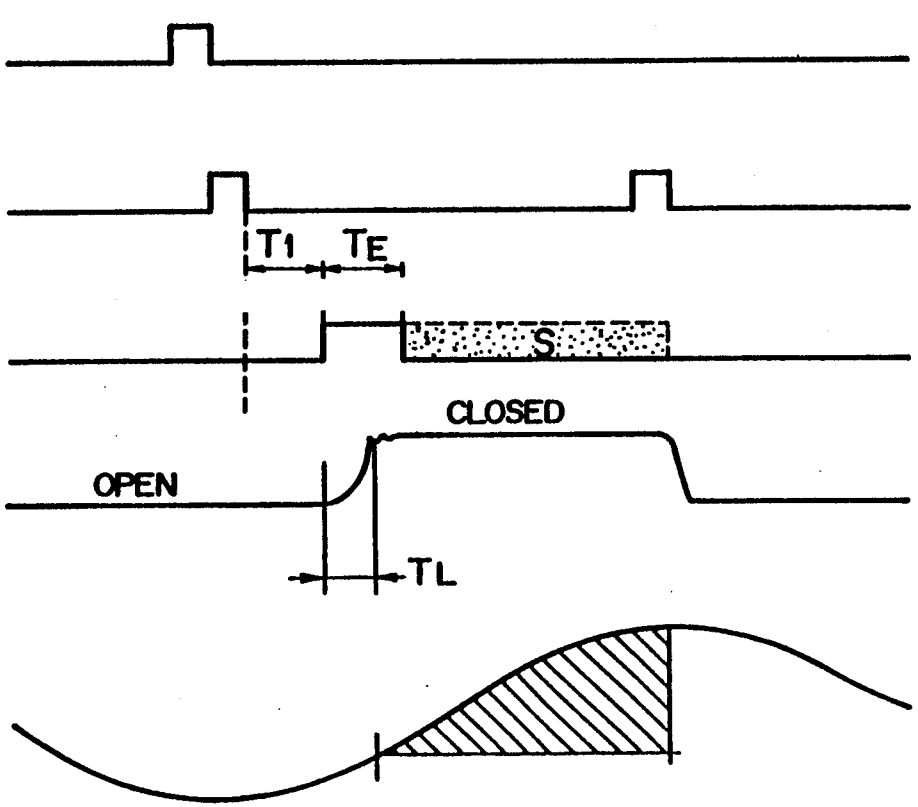
FIGS. 6(A)-6(E) are also time charts diagrammatically illustrating another example of the opera ion of the fuel injection system to which the present invention is applied.

In FIG. 6, the lines A–E illustrate, respectively, the signal generated by the cylinder-judgement sensor 62 shown in FIG. 2, the signal generated by the cam angle sensor 50, the control signal fed to the solenoid valves 30, the lift of the valve member 38 of each solenoid valve 30 and the lift of each cam 13.

In the example of the operation shown in FIG. 6, a control signal is fed from the ECU 40 to each solenoid valve 30 after the lapse of a predetermined time period $T_1$ from a cam angle signal and lasts for a time period $T_E$ which is slightly longer than a response time $T_L$ required for the valve member 38 of each solenoid valve to be moved from the open position to the closed position.

More specifically, when the control signal is fed from the ECU 40 to each solenoid valve 30, the valve member 38 of the solenoid valve 30 is magnetically lifted into sealing engagement with an associated valve seat. The response time $T_L$ shown in FIG. 6 is a time period which is required for the valve member 38 to be moved into engagement with the valve seat after the solenoid valve 30 is electrically energized by the ECU 40. After the valve member 38 is engaged with the valve seat, the low pressure passage 31 is disconnected from the pumping chamber 16, so that the plunger starts a pressurization of the fuel in the pumping chamber 16 to abruptly raise the pressure therein.

Immediately thereafter, the valve member 38 tends to be opened by the force of the spring 35 because the supply of the control signal from the ECU 40 to the solenoid valve 30 is stoped after the lapse of a time period $T_E$. At this time, however, the high fuel pressure in the pumping chamber 16 is acting on the valve member 38 to keep the same in sealing engagement with its valve seat, whereby the solenoid valve is kept closed.

Thus, the pressurized fuel is discharged from the pumping chamber 16 through the discharge valve 20 into the common rail 4, as indicated by a hatched zone shown in FIG. 6, until the pressurizing stroke of the plunger 15 is completed. The pressure in the pumping chamber 16 is then lowered, so that the valve member 38 of the solenoid valve 30 is moved by the force of the spring 35 to the open position.

As compared with the operation described with reference to FIGS. 1–5, the operation illustrated in FIG. 6 advantageously saves an electrical energy represented by an area S shown in FIG. 6. In addition, it is not required to control the duration of the control signal fed from the ECU 40 to each solenoid valve 30 dependent on the engine operation condition. Thus, it is only required to set the time period $T_E$ while the solenoid valve control signal lasts. This greatly simplifies the control of the variable discharge high pressure pump 7 by the ECU 40.

Another embodiment of the invention will be described with reference to FIGS. 7–12 in which the reference numerals the same as those used in the preceding embodiment are used to denote the same members and component parts.

When the operation of a Diesel engine is changed from a rated operation condition to a high speed operation condition, it is necessary to reduce the common rail pressure to a level below the value which is determined by the critical limit of the mechanical strength of the fuel supply circuit of the fuel injection system. In general, this pressure-reduction control is carried out by means of an electrical control system for controlling the high pressure feed pump. Thus, for example when an engine speed sensor for the Diesel engine or the pressure sensor for detecting the common rail pressure erroneously detects the engine speed or the common rail pressure, the necessary pressure-reduction control is not properly carried out with a result that the reliability and the endurance of the system are lowered. If such an inferior operation is continued, the fuel supply system and, particularly, the mechanical structure thereof, are deteriorated in a short time.

If the discharge of the high pressure supply pump is set to be an unduly restricted value so as to clear the critical limit of the mechanical strength of the fuel supply circuit in order to avoid the problem which would be caused by the high pressure fuel supply during a high speed engine operation, the common rail pressure will not be raised to a predetermined desired level when the engine is operated within a low speed or rated speed operation range. Thus, if the discharge of the high pressure supply pump is set to be unduely restricted value in order to sufficiently clear the critical limit of the mechanical strength of the fuel supply circuit, the pump not only gives rise to deterioration of the engine driveability but also fails to be suited for general use.

Thus, the other embodiment of the variable discharge high pressure pump to be described hereunder is intended to control the discharge to reliably prevent, with a simple structure, the common rail pressure from being raised beyond a critical strength limit when the operation of an associated Diesel engine is changed from a rated operation into a high speed operation.

Figure 7:
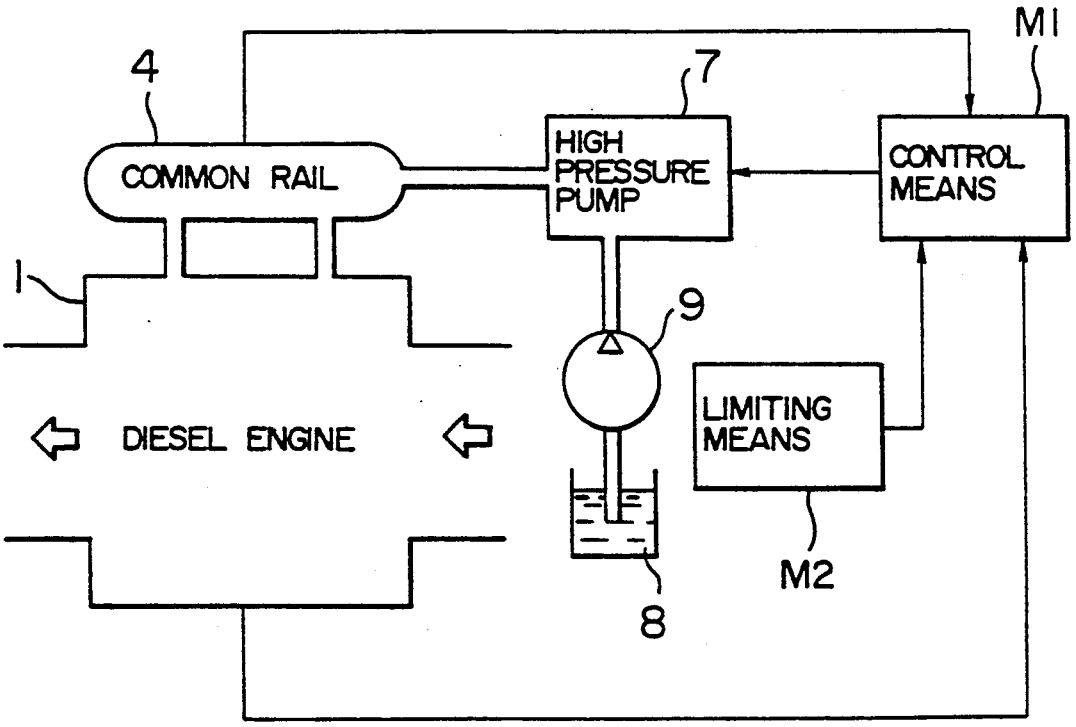
FIG. 7 is a diagrammatic illustration of another arrangement of a fuel injection system to which the present invention is applied.

The embodiment shown in FIG. 7 is characterised in that, when the discharge commencement timing determined by a control means Ml is advanced than a discharge commencement timing so predetermined as to assure the maximum pump discharge until a Diesel engine 1 is brought into rated speed, a limiting means M2 is provided to limit the discharge commencement timing determined by the control means 1 to the said predetermined discharge commencement timing. When the discharge commencement timing determined by the control means Ml is retarded than a predetermined discharge commencement timing, the discharge commencement timing may be unchanged and, when the discharge commencement timing is advanced than the predetermined discharge commencement timing, the discharge commencement timing may be retarded to the predetermined discharge commencement timing.

The control means M1 and the limiting means M2 may be either independent discret logic circuits or logic operation circuits formed by known CPU, ROM, RAM and other peripheral circuit elements.

Figure 8:
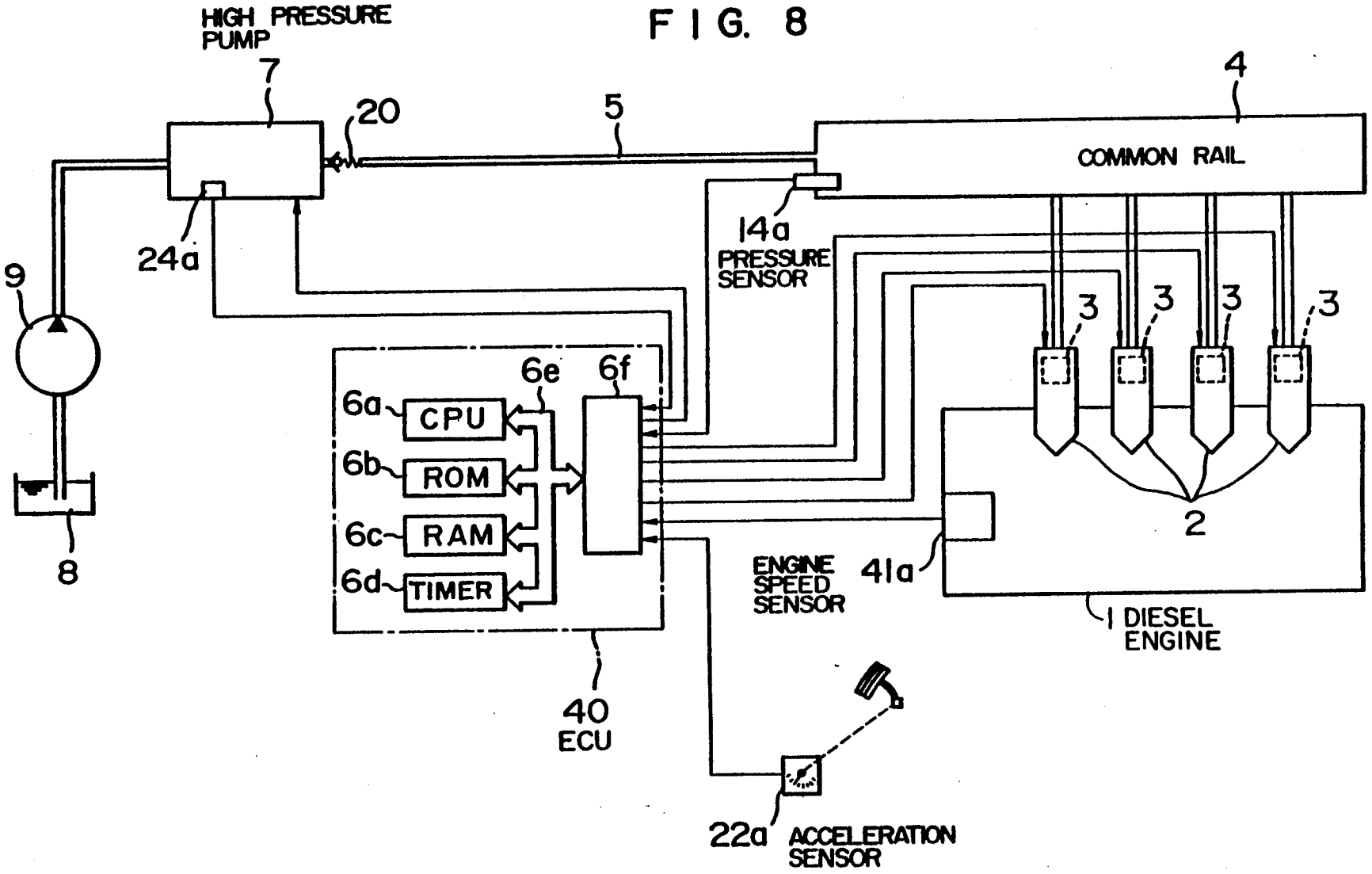
FIG. 8 diagrammatically illustrates in more detail the arrangement shown in FIG. 7.

Referring to FIG. 8, a common rail type fuel injection system includes fuel injectors 2 associated with cylinders of a four-cylinder Diesel engine 1, a common rail 4 for accumulating a high pressure of fuel to be fed to the injectors 2, a variable discharge high pressure pump 7 for supplying the common rail 4 with the fuel at a high pressure, and an electrical control unit (ECU) 40. The ECU 40 is operative to electrically energize and deenergize fuel injection solenoid valves 3 to control the fuel injection characteristics such as the amounts of fuel to be fed to respective engine cylinders and fuel injection timing. The common rail 4 is connected to the high pressure pump 7 through a fuel supply piping 5 and a discharge valve 20 so that the fuel is supplied at a high pressure to the common rail.

The variable discharge high pressure pump 7 is supplied with the fuel at a low pressure level from a low pressure pump 9 which sucks the fuel from a fuel tank 8. The high pressure pump 7 feeds the fuel at a high pressure level to the common rail 4 to maintain the high pressure therein.

The common rail type fuel injection system shown in FIG. 8 includes an engine speed sensor 41*a* for detecting the speed of an associated Diesel engine, an accelerator sensor 22*a* for detecting the amount of actuation of an engine accelerator and thus the engine load, a pressure sensor 14*a* for detecting the common rail pressure in the common rail 4, and a cam angle sensor 24*a* for detecting the angle of rotation of a cam shaft in the variable discharge high pressure pump 7.

Signals generated by the sensors referred to above are fed into an ECU 40 which controls the solenoid valves 3 of the injectors 2 and the variable discharge high pressure pump 7.

The ECU 40 is formed as a logic operation circuit including a CPU 6*a*, a ROM 6*b*, a RAM 6*c* and a timer 6*d* which are connected via a common pass 6*a* to an input and output section 6*f* through which various signals are received by the ECU 40 from outside thereof and fed therefrom to the solenoid valves 3 and the pump 7. The signals from respective sensors passes through the input and output section 6*f* to the CPU 6*a* which, in turn, emits control signals through the input and output section 6*f* to the solenoid valves 3 of the injectors 2 and to the variable discharge high pressure pump 7.

Figure 9:
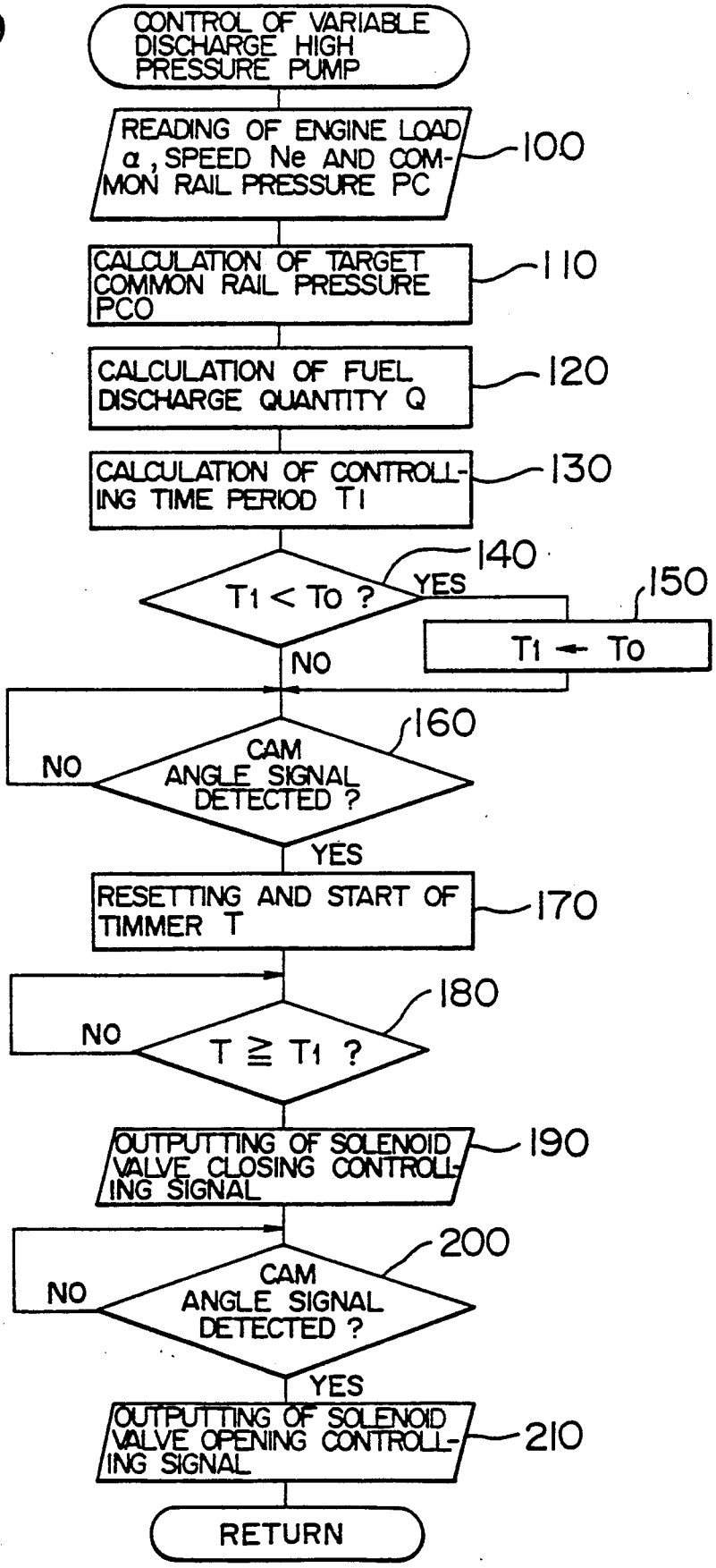
FIG. 9 is a flow chart for controlling the variable discharge high pressure pump of the invention in a manner different from the controlling method described with reference to FIGS. 5 and 6.

The operation of the common rail type fuel injection system shown in FIG. 8 will be described with reference to a flow chart shown in FIG. 9. The control of the variable discharge high pressure pump is carried out upon commencement of the operation of the ECU 40. At first, an engine load $\alpha$, an engine speed Ne and a common rail pressure PC are read in step 100. In a succeeding step 110, a target common rail pressure PCO is calculated from the engine load $\alpha$ and speed Ne read in the step 100 and by using an equation of a map. The process proceeds to a step 120 where a quantity of fuel discharge Q is calculated from the target common rail pressure PCO calculated in the step 110 and from the common rail pressure PC read in the step 100 and by using an equation or a map. In a succeeding step 130, a controlling time period T1 is calculated from the fuel discharge quantity Q calculated in the step 120 and from the engine speed Ne read in the step 100 and by using an equation or a map. The process proceeds to a step 140 where whether the controlling time period T1 calculated in the step 130 is smaller than a minimum controlling time period TO or not is judged. If the answer is YES, the process proceeds to a step 150. On the other hand, if the answer is NO, the process proceeds to a step 160. In the step 150, the controlling time period T1 is adjusted to be the maximum controlling time period TO. In the step 160, whether a cam angle signal is detected or not is judged. If the answer is YES, the process proceeds to a step 170. If the answer is NO, the same step is repeated until the cam angle signal is detected. In the step 170, a timer T is reset and started. In a succeeding step 180, whether the time period measured by the timer T is longer than the controlling time period T1 calculated in the step 130 or adjusted in the step 150. If the answer is YES, the process proceeds to a step 190. On the other hand, if the answer is NO, the same step is repeated until the controlling time T1 lapses. In the step 190, a controlling signal is emitted to close the solenoid valves 3, so that the pressurization and discharge of the fuel are commenced. In a succeeding step 200, whether the cam angle signal has been detected or not is judged. If the answer is YES, the process proceeds to a step 210. On the other hand, if the answer is NO, the same step is repeated until the cam angle signal is detected. In the step 210, a controlling signal is emitted to open the solenoid valves 3, so that the pressurization and discharge of the fuel are interrupted. After the step 210 is carried out, one cycle of the control of the variable discharge high pressure pump is completed and the control is cyclically repeated at predetermined time intervals.

Figure 10:
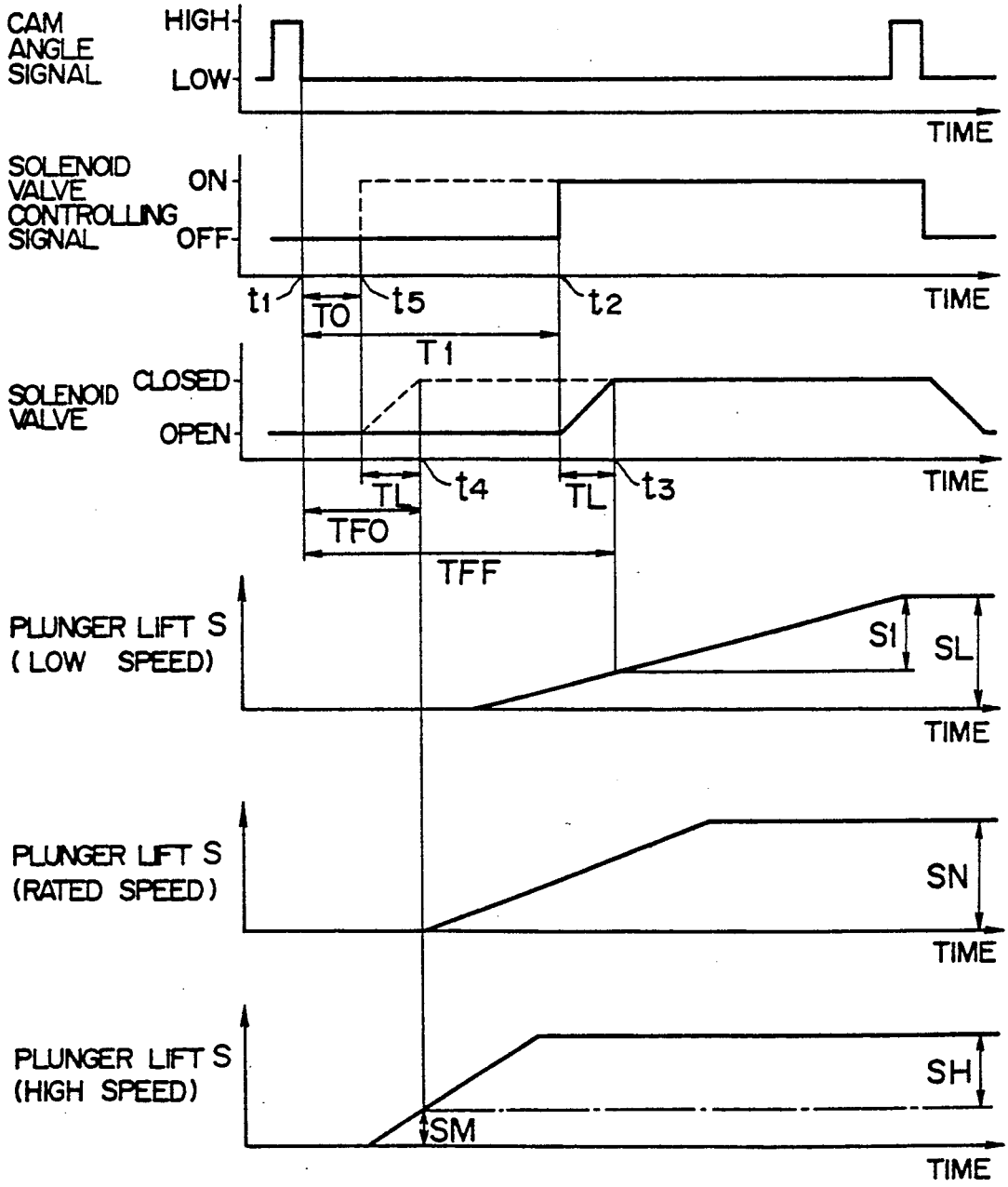
FIG. 10 is a time chart of the operation of the pump of the invention which time chart is based on the flow chart shown in FIG. 9.

An example of the manner of the control described above will now be described with reference to the timing chart shown in FIG. 10. As shown by solid lines in FIG. 10, a cam angle signal is detected at a time point t1. After the lapse of the controlling time period T1 from the time point t1, a controlling signal to close the solenoid valves 3 is emitted at a time point t2. After the lapse of a time lag TL from the time point t2, the pressurization and discharge of the fuel are commenced at a time point t3. An operation time TFF measured from the time point t1 when the cam angle signal is detected to the time point t3 when the pressurization and discharge of fuel are commenced is equal to the sum of the controlling time period T1 and the time lag TL.

Because the lift of each plunger is of a constant value, the more advanced the commencement of the pressurization and discharge is, the greater the discharge stroke is and, thus, the more the quantity of the fuel discharged is. For example, for the operation time TFF and for a low speed operation of a Diesel engine, the discharge stroke is S1. If the operation time TFF is set to be shorter, namely, if the controlling time period T1 is shortened, the discharge stroke becomes the maximum stroke SL. As such, if the controlling time period T1 is shortened, the discharge stroke is increased, and vice versa. By adjusting the controlling time period T1, therefore, it is possible to control the quantity Q of fuel to be discharged. When the Diesel engine is operating in a rated operation condition, the maximum discharge stroke SN can be obtained by making the plunger lift S to be equal to the#discharge stroke SN; namely, by commencing the discharge of the fuel at a time point t4 which is retarded by an operation time TFO from the time point T1 when the cam angle signal is detected. In this case, the controlling time period is T0 which is equal to the operation time TFO minus the time lag TL. In other words, it is necessary to supply the solenoid valves with a controlling signal at a time point t5, as shown by a broken line in FIG. 10. The controlling time period TO is set to be minimum, so that, if the controlling time period T1 is set to be a predetermined time period longer than the minimum controlling time period TO within a range from a low speed engine operation condition to a rated speed engine operation condition, the discharge stroke can be adjusted to be any desired value within a range of from zero to the maximum plunger lift S. Thus, the quantity Q of the fuel to be discharged can also be adjusted within a range of from zero to the maximum value Qmax. In a high speed engine operating condition, however, the controlling time period T1 is so set as not to be restricted beyond the minimum controlling time period TO. At the time point t4 at which the discharge is commenced, therefore, the plunger has already been lifted a distance SM. In this case, therefore, the maximum value of the discharge stroke is limited to restrict the quantity Q of fuel discharge to a value less than the maximum fuel discharge quantity Qmax. It will, therefore, be understood that the quantity of fuel to be discharged by the pump is reduced as the engine speed is increased.

In the described embodiment of the invention, the steps 100–130 and 160–190 are carried out by the controlling means Ml shown in FIG. 7 while the steps 140 and 150 are carried out by the limiting means M2 also shown in FIG. 7.

Figure 11:
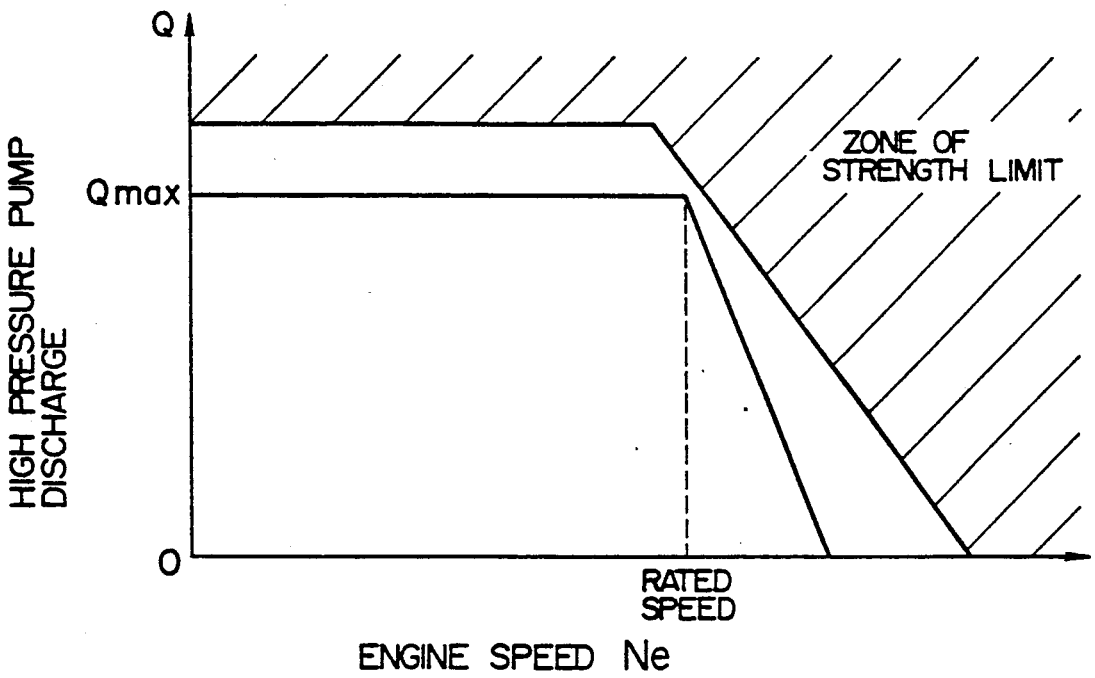
FIGS. 11 and 12 graphically illustrate the relationship between the pump discharge and the engine speed based on the pump operation shown in FIG. 10.

As will be understood from the foregoing description, according to the described embodiment of the invention, even if the operation of the Diesel engine 1 is changed from a rated speed operation condition to a high speed operation condition due to an erroneous operation of the engine speed sensor 41*a* or the common rail pressure sensor 14*a*, the quantity Q of the fuel discharged from the variable discharge high pressure pump 7 is reduced to lower the fuel pressure accumulated in the common rail 4, i.e., the common rail pressure PC. Thus, the common rail type fuel injection system can be operated with the fuel pressure kept at a level below the critical limit of the mechanical strengths of the variable discharge high pressure pump 7, the supply piping 5, the common rail 4 and the injectors 2. Thus, even if an error takes place in the operation of the engine speed sensor 41*a* or the pressure sensor 14*a*, the common rail type fuel injection system is operative with improved reliability and durability. More specifically, as shown in FIG. 11, the quantity Q of discharge can be set to be any desired value within a range up to the maximum quantity of discharge Qmax when the engine operation speed Ne is less than the rated speed. On the other hand, when the engine speed exceeds the rated speed, the quantity of discharge is quickly decreased. Thus, the fuel pressure in the common rail 4 is lowered when the engine speed Ne exceeds the rated speed. Thus, the fuel pressure in the fuel injection system will not be raised beyond the critical limit of the mechanical strengths of various component parts of the system.

Figure 12:
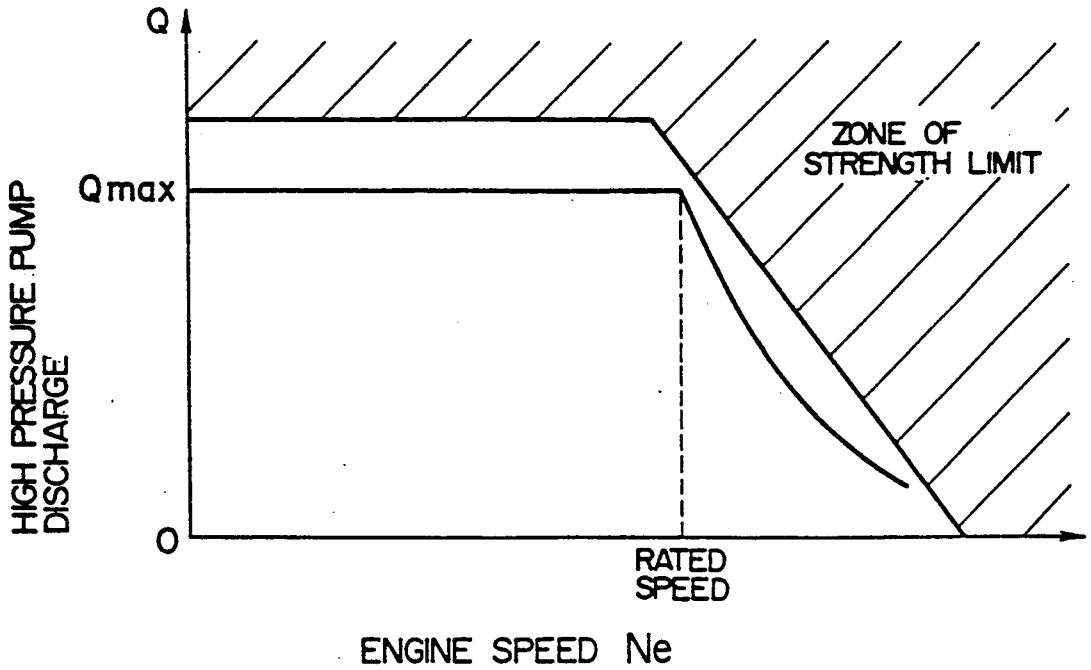

In addition, because the fuel to be sucked into the variable discharge high pressure pump 7 is restricted by the orifice 42*b* (see FIG. 1), the amount of fuel which can be sucked into the pump 7 during one cycle of pumping operation is reduced when the engine speed is increased beyond the rates speed. Thus, when the engine speed Ne exceeds the rates speed even when an electrical error, such as an error in the ECU 40 due to problem caused by an electromagnetic wave or a trouble of the operation of the solenoid valves 30, takes place, the quantity Q of fuel to be discharged is decreased to prevent the common rail pressure PC in the common rail 4 from being raised. More specifically, as shown in FIG. 12, when the engine speed Ne is lower than the rated speed, the fuel discharge quantity Q can be set to be any desired value within a range up to the maximum discharge quantity Qmax. 0 the other hand, when the engine speed exceeds the rated speed, the fuel discharge quantity is reduced, as shown by a curve in FIG. 12. Thus, even if the engine speed Ne is increased beyond the rated speed during an abnormal operation of the ECU 40 or the solenoid valves 30, the provision of the restriction orifice 42*b* for the pump 7 provides an advantage that the fuel discharge quantity Q is decreased to lower the fuel pressure in the common rail 4 regardless of the occurrence of a problem in the electric circuits to assure that the common rail pressure is prevented from being unduly raised to a level above the critical limit of the mechanical strength of the fuel injection system and that the high pressure fuel supply circuit is prevented from being subjected to a dangerously high fuel pressure.

As described above, the variable discharge high pressure pump is controlled by the ECU 40 such that the controlling time period T1 is kept longer than the minimum controlling time period TO. In addition, the orifice 42*b* restricts the amount of fuel to be sucked into the pump when the ECU 40 is in an abnormal operation. Thus, the common rail type fuel injection system shown in FIG. 8 is provided with double, namely, electrical and mechanical, fail-safe means to assure that the fuel supply circuit of the system is given improved reliability and durability in terms of mechanical strength. This is particularly advantageous in the case where the system is used with a Diesel engine to be mounted on automobiles which call for a high reliability of fuel injection system.

In addition, in the case where the Diesel engine 1 is operated in an operating range of from a low speed operation to a rated speed operation, the pump operation is so controlled that the discharge of the pump does not exceed the possible maximum quantity Qmax and keeps the common rail pressure PC always at a target common rail pressure PCO determined in accordance with the engine operating condition to thereby insure a good operating condition of the Diesel engine 1.

Moreover, the controlling time period T1 calculated from the load 2 of the Diesel engine 1 and the common rail pressure PC in the common rail 4 is restricted so as not to be shorter than the minimum controlling time period T0 determined in accordance with the rated speed engine operation condition. In addition, the simple orifice 42*b* is merely provided for the pump to maintain the fuel pressure in the common rail 4 at a level lower than the critical limit of the mechanical strength of the fuel supply circuit. Thus, the simple structure and arrangement reliably eliminate the occurrence of deterioration of the operation condition of the common rail type fuel injection system and the application of undue mechanical load onto the mechanical sections of the system, which would otherwise occur due to erroneous detections of various sensors and erroneous operations of the ECU 40 and solenoid valves 30.

Moreover, the minimum controlling time period T1 may be varied in accordance with applications of the variable discharge high pressure pump 7 to adapt the pump to various common rail type Diesel engines.

A further embodiment of the variable discharge high pressure pump of the invention will be described hereinunder. This embodiment of the variable discharge high pressure pump has cams 13 each having a modified constant speed cam profile which is shaped such that cam speed is low in the initial stage of the forward stroking movement of the plunger and the cam speed is high in the later stage of the forward stroking movement of the plunger. The cam profile may be a composite curve formed by modified trapezoidal curves, a composite curve formed by modified sine curves or a universal cam curve.

According to this embodiment, in the case where the pressurization and discharge of fuel are commenced at an early timing, the plunger commences the pressurization and discharge of the fuel in an early part of its forward stroking movement. Thus, the cam speed is low to reduce the fuel pressure and the quantity of fuel discharged per unit of time. On the other hand, in the case where the pressurization and discharge of fuel are commenced at a late timing, the plunger commences the pressurization and discharge in the later part of its forward stroking movement. The cam speed is high to increase the fuel pressure and the quantity of fuel discharged per unit of time. Accordingly, this embodiment of the variable discharge high pressure pump is operative to maintain the accumulated fuel pressure at a desired level even if the duration of the pressurization and discharge of fuel is varied.

The cam 13 has an operating characteristic given by a modified constant speed cam profile, as described above. For a predetermined angle of rotation of the cam 13, therefore, the plunger is moved a short distance and at a low speed in the early part of its forward stroking movement. For the same angle of rotation of the cam, however, the plunger is moved a long distance and at a high speed in the later part of its forward stroking movement. Thus, if the solenoid valve is electrically energized in the early part of the forward stroking movement of the plunger, the mean cam speed is low, so that the quantity of fuel discharged per unit of time, i.e., the so-called rate of fuel discharge, is small and the fuel pressure is also relatively low. On the other hand, if the solenoid valve is energized in the later part of the forward stroking movement of the plunger 15, the mean cam speed is high, so that the quantity of fuel discharged per unit of time, i.e., the rate of fuel discharge, is large and the fuel pressure is also relatively high.

Figure 13:
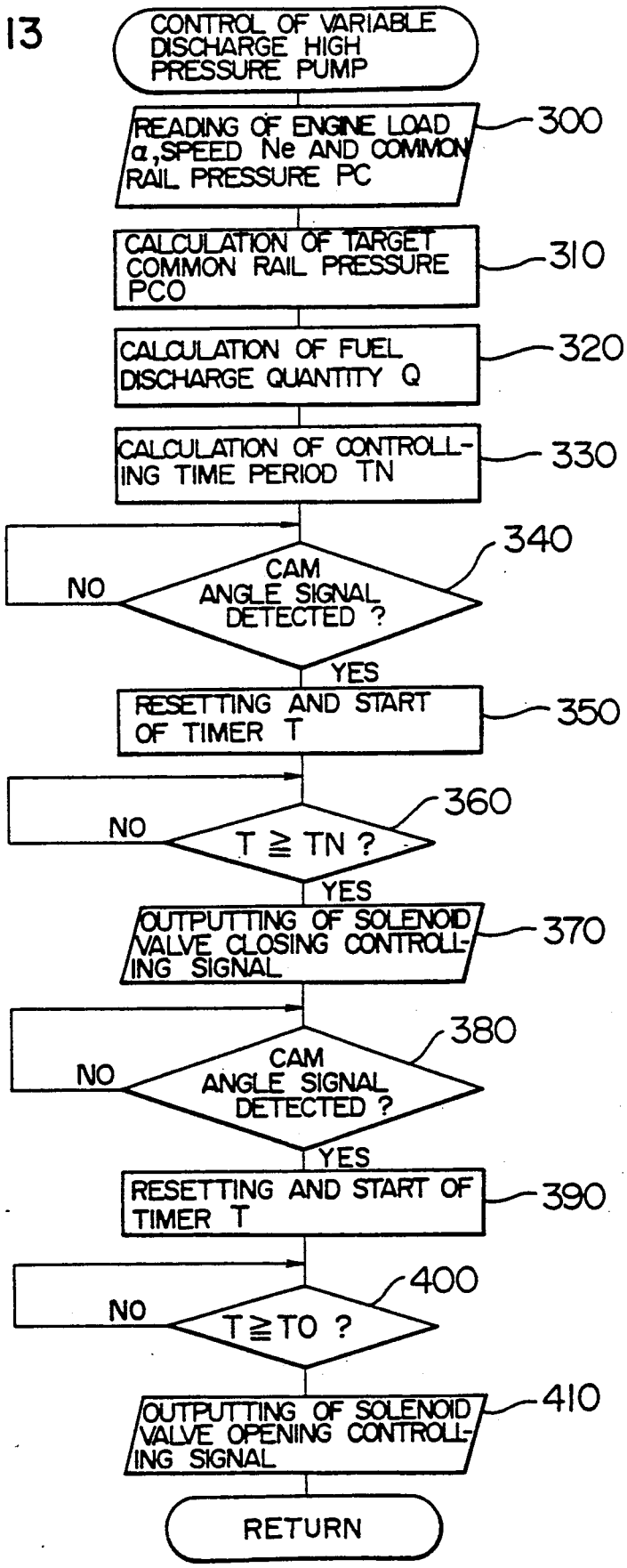
FIG. 13 is a flow chart for controlling another embodiment of the pump of the invention in a still another manner.

The operation of a common rail type fuel injection system which utilizes the described embodiment of the variable discharge high pressure pump will be described with reference to a flow chart shown in FIG. 13. The control of the variable discharge high pressure pump is commenced by starting the operation of the ECU 40. In a step 300, the engine load $\alpha$, the engine speed Ne and the common rail pressure PC are read first. In a succeeding step 310, a target common rail pressure PCO is calculated from the engine load $\alpha$ and the engine speed Ne both read in the step 300 and by using an operating equation or map. The process then proceeds to a step 320 in which a target quantity Q of fuel to be discharged is calculated from the target common rail pressure PCO calculated in the step 310 and from the common rail pressure PC, the engine speed Ne and engine load $\alpha$ all read in the step 300 and by using an operating equation or a map. In a succeeding step 330, a controlling time period TN is calculated from the quantity of discharge Q calculated in the step 320 and from the engine speed Ne read in the step 300 and by using an operating equation or a map. The process then proceeds to a step 340 in which whether a cam angle signal has been detected or not is judged. If the answer is YES, the process proceeds to a succeeding step 350. On the other hand, if the answer is NO, the same step is repeated until the cam angle signal is detected. In the step 350, a timer T is reset and started. In a succeeding step 360, whether the time period measured by the timer T started in the step 350 is longer than the controlling time period TN or not is judged. If the answer is YES, the process proceeds to a step 370. If the answer is NO, the same step is repeated until the controlling time period TN lapses. In the step 370, a controlling signal is output to close the solenoid valve 30 so that the pressurization and discharge of fuel are commenced. In a succeeding step 380; whether a cam angle signal has been detected or not is judged. If the answer is NO, the process proceeds to a step 390. On the other hand, if the answer is YES, the same step is repeated until the cam angle signal is detected. In the step 390, the timer T is reset and started. In a succeeding step 400, whether the time period measured by the timer started in the step 390 is longer than a predetermined waiting time period TO or not is judged. If the answer is YES, the process proceeds to a step 410. On the other hand, if the answer is NO, the same step is repeated until the waiting time period T0 lapses. In the step 410, a controlling signal is output to open the solenoid valve 30 to enable the pump to be prepared to suck the fuel to be discharged in a succeeding discharge stroke. When the step 410 has been carried out, the process for controlling the variable discharge high pressure pump is completed. Thereafter, the steps 300–410 are cyclically repeated at predetermined time intervals.

Figure 14:
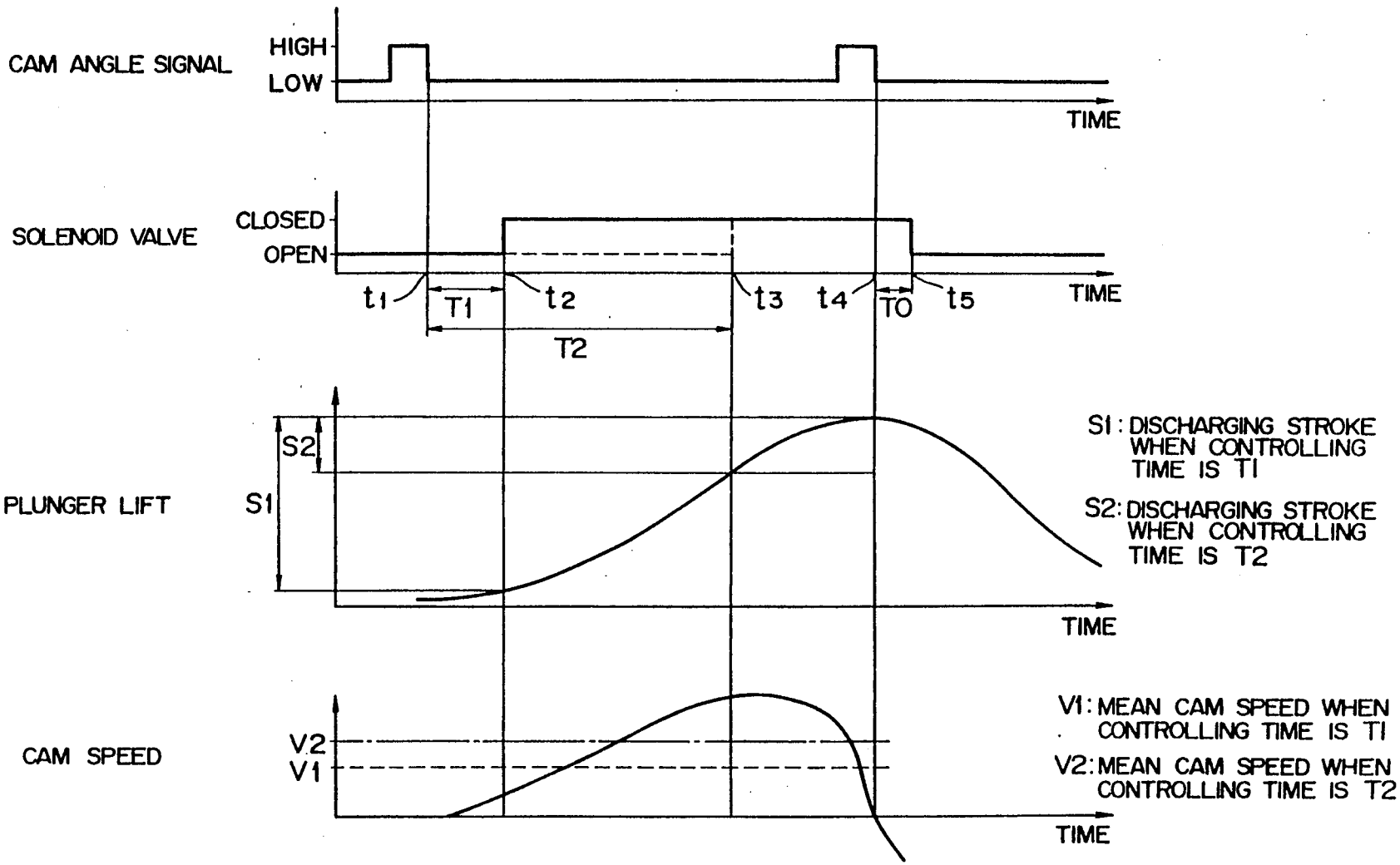
FIG. 14 is a time chart of the operation of the pump of the invention shown in FIG. 13.

An example of the control described above will be described with reference to a timing chart shown in FIG. 14. As shown by solid lines, in the case where the pressurization and discharge are commenced at an early timing, a controlling signal for closing the solenoid valve 30 to commence the pressurization and discharge of the fuel is output at a time point t2 which is later by a shorter controlling time period T1 than a time point t1 at which a cam angle signal is detected. At time point t2, the lift S of the plunger 15 is of a small value, so that the discharge stroke is of a large value S1 with a resultant large quantity of discharge Q. A next cam angle signal is detected at a time point t4, from which a waiting time T0 passes to a time point t5 at which a controlling signal for opening the solenoid valve 30 is emitted. On the other hand, as shown by broken lines in FIG. 14, in the case where the pressurization and discharge of the fuel are commenced at a late timing, a controlling signal for closing the solenoid valve 30 is emitted to commence the pressurization and discharge of the fuel at a time point t3 which is later by a longer controlling time period T2 than the time point t1 at which a cam angle signal is detected. At the time point t3, the lift S of the plunger 15 is of a large value, so that the discharge stroke is of a small value S2 with a resultant small quantity of discharge Q. As such, if the controlling time period TN is shortened, the discharge stroke is increased. On the other hand, if the controlling time period TN is extended, the discharge stroke is decreased. Thus, the quantity of discharge Q can be controlled to be of a desired value by adjusting the controlling time period TN.

The cam 13 is designed such that the cam speed is low in the early stage of the forward stroking movement of the plunger and is high in the later stage of the plunger forward stroking movement. In the case where the controlling time period TN is the shorter one T1, namely, in the case where the quantity of the discharge Q is large, the mean cam speed during the pressurization and discharge of fuel is as low as V1, as shown by a broken line in FIG. 14, with a result that the quantity of fuel discharged per unit of time, i.e., the rate of fuel discharge, and the discharging pressure are both lowered. On the other hand, in the case where the controlling time period TN is the longer one T2, namely, in the case where the quantity of fuel discharge Q is small, the mean cam speed is as high as V2, as shown by a dot and dash line in FIG. 14, with a result that the quantity of fuel discharged per unit of time, i.e., the rate of fuel discharge, and the discharging pressure are both increased. As such, because the cams 13 of the variable discharge high pressure pump 7 each have such a cam profile so shaped as to vary the cam speed, the pump operates such that the rate of discharge is decreased when the quantity of discharge Q is large to prevent undue rise of the discharging pressure and such that, when the quantity of discharge Q is small, the rate of discharge is increased to prevent drop of the discharge pressure.

As will be understood from the foregoing description the described embodiment is operative to assure that, in the case where the controlling time period TN is shorter, i.e., in the case where the pressurization and discharge are commenced at an early timing, any abrupt increase in the common rail pressure PC can be avoided and, in the case where the controlling time TN is longer, i.e., in the case where the pressurization and discharge are commenced at a late timing, any abrupt drop of the common rail pressure PC can be eliminated, whereby the actual common rail pressure PC can stably be kept at a target common rail pressure PCO.

Thus, even in the case where the target common rail pressure PCO is varied in dependence on the operating condition of the Diesel engine 1, the actual common rail pressure PC can quickly follow the variation, with a resultant advantage that the common rail pressure can be kept at an optimum level under various engine operating conditions.

In addition, in the case where the quantity of discharge Q is large, i.e., in the case where the controlling time period TN is shorter, the plunger 15 commences the pressurization and discharge in an early stage of its forward stroking movement. Thus, the cam speed is low, so that the torque required to drive the variable discharge high pressure pump can be decreased to save the energy. This contributes to an advantage that the external load on the Diesel engine 1 can be reduced and the efficiency of fuel consumption of the Diesel engine and the engine driveability are both improved.

Moreover, because the control to keep the common rail pressure PC at a target common rail pressure PCO is carried out with improved response and follow-up, the accuracy of the common rail pressure control is improved to increase the stability of the control to keep the common rail pressure PC at a target common rail pressure PCO as well as to improve the reliability of the generation of the common rail pressure PO by the variable discharge high pressure pump.

Further more, since the advantages are achieved by the simple mechanism comprising the cams 13, the variable discharge high pressure pump 7 provides an improved reliability.

What is claimed is:

1. A variable discharge high pressure lamp for a fuel injection system of an engine, said high pressure lamp discharging fuel into a common rail for accumulating a fuel pressure therein, said high pressure pump including:

a cylinder having formed therein at least one cylinder bore;

an irregular shaped cam, coupled to rotate with said engine;

a plunger reciprocally disposed in said cylinder bore, and reciprocating based on a rotation of said cam, having an end face cooperating with an inner peripheral surface of said cylinder bore to define a pumping chamber, and pressurizing the fuel in said pumping chamber in a forward stroking movement thereof so that at a first position of said cam, said plunger is in a position that a size of said pumping chamber is maximum, and when said cam is in a second position, said plunger is in a position where a size of said pumping chamber is minimum; and valve means including a valve member for opening and closing a low pressure passage, communicating said pumping chamber with a lower pressure chamber, said valve member closing said communicating during said forward stroking movement of said plunger while said cam is between said first and second positions to increase a pressure in said pumping chamber and thereby define a timing of beginning pressurizing the fuel in said pumping chamber;

wherein the discharge of fuel into said common rail from said pressure chamber is finished only at an end of said forward stroking movement of said plunger when said cam is in said second position.

2. A high pressure pump according to claim 1, wherein said plunger is a cylindrical shape without notches or grooves therein.

3. A high pressure pump according to claim 1, further including a camshaft adapted to a rotated by one-half a rotation of said engine, said cam being coupled to said camshaft for reciprocally driving the plunger, said cam being of a shape having a plurality of cam lobes, each cam lobe having said first position and said second position so that said plunger is driven a plurality of times equal to a number of cam lobes of said cam.

4. A high pressure pump according to claim 1, wherein said cylinder has formed therein a fuel chamber communicated with a low pressure source of fuel for pressurizing by said plunger, and communication with said low pressure chamber and a fuel inlet provided with a restriction orifice restricting the flow of the fuel therethrough to a predetermined rate.

5. A high pressure pump according to claim 1, wherein said plunger is substantially cylindrical.

6. A high pressure pump according to claim 1, wherein said cam has a cam profile so shaped that a speed of movement of said plunger is low in an initial stage of a forward stroking movement of said plunger and is high in a late stage of the forward stroking movement of said plunger.

7. A variable discharge high pressure pump for a fuel injection system of an engine, said high pressure pump discharging fuel into a common rail for accumulating a fuel pressure therein, said high pressure pump including:

a cylinder having formed therein at least one cylinder bore;

an irregular shaped cam, coupled to rotate with said engine;

a plunger reciprocally disposed in said cylinder bore to reciprocate based on a rotation of said cam, having an end face cooperating with an inner peripheral surface of said cylinder bore to define a pumping chamber, and pressurizing the fuel in said pumping chamber in a forward stroking movement thereof, so that at a first position of said cam, said plunger is in a position that a size of said pumping chamber is maximum, and when said cam is in a second position, said plunger is in a position where a size of said pumping chamber is minimum; and a solenoid valve including a valve member for opening and closing a low pressure passage communicating said pressure chamber with a lower pressure chamber, said valve member being opened outwardly from said solenoid valve when said solenoid valve is deenergized, and being closed inwardly when energized, said closing stopping said communicating, and occurring during said forward stroking movement of said plunger while said cam is between said first and second positions to define a timing of beginning pressurizing the fuel in said pumping chamber, and said valve member being disposed to receive a force from the pressurized fuel in said pumping chamber which urges said valve member more toward the closed position when said valve member is closed;

wherein the discharge of the fuel into said common rail from said pressure chamber is finished only at an end of said forward stroking movement of said plunger when said cam is in said second position.

8. A high pressure pump according to claim 7, wherein said plunger is a cylindrical shape without notches or grooves therein.

9. A high pressure pump according to claim 7, further including a cam shaft adapted to a rotated by one-half a rotation of said engine and said cam coupled to said camshaft for reciprocally driving the plunger, said cam being of a shape having a plurality of cam lobes, each cam lobe having said first position and said second position, so that said plunger is driven a plurality of times equal to a number of cam lobes of said cam.

10. A high pressure pump according to claim 7, wherein, each time when the valve member is closed, the solenoid valve is electrically energized or a time period slightly longer than a response time required for the closing of said valve member.

11. A high pressure pump according to claim 7, wherein said cylinder has formed therein a fuel chamber communicated with a low pressure source of fuel for pressurizing by said plunger, and communicating with said low pressure chamber and a fuel inlet provided with a restriction orifice restricting the flow of the fuel therethrough to a predetermined rate.

12. A high pressure pump according to claim 7, wherein said plunger is substantially cylindrical.

13. A high pressure pump according to claim 7, further comprising an electronic control unit responsive to signals representative an engine load, an engine speed and a fuel pressure in said common rail, wherein said solenoid valve is controlled by said electronic control unit.

14. A high pressure pump according to claim 7, wherein said common rail is adapted to accumulate a high pressure of fuel to be injected into a Diesel engine, further comprising an electronic control unit, wherein said solenoid valve is controlled by said electronic control unit, operated in dependence on a discharge-commencement timing determined by said electronic control unit based on an operating condition of said Diesel engine and the pressure in said common rail, the control being such that, in the case where the discharge-commencement timing based on the engine operating condition and the common rail pressure is earlier than a discharge-commencement timing so predetermined as to assure a maximum discharge of the pump, said electronic control unit controls the solenoid valve to restrict the discharge-commencement timing based on the engine operating condition and said common rail pressure to said predetermined discharge-commencement timing until the operating condition of said Diesel engine reaches a rated operating condition.

15. A high pressure pump according to claim 14, wherein said electronic unit determines the quantity of the fuel to be discharged by the pump such that, when the operating condition of said Diesel engine is changed from the rated operating condition to a high speed operating condition, the quantity of fuel discharged per unit of time is limited so as not to raise the common rail pressure beyond a critical limit of the mechanical strength of a fuel supply circuit including said common rail.

16. A high pressure pump according to claim 7, further including a cam rotated by the engine to reciprocally drive said plunger, said cam having a cam profile so shaped that the cam speed is low in an initial stage of a forward stroking movement of said plunger and is high on a late stage of the forward stroking movement of said plunger.

17. A variable discharge high pressure pump for a fuel injection system of an engine for discharging fuel into a common rail for accumulating a fuel pressure therein, said high pressure pump comprising:

a cylinder having formed therein at least one cylindrical bore with an inner peripheral surface, having at least a first supply opening, coupled to a low pressure fuel supply from which fuel to be pressurized is supplied, and a second, low pressure passage opening which leads to said supply opening;

an irregular shaped cam, coupled to rotate with said engine;

a cylindrical plunger movably disposed in said cylindrical bore, to reciprocate based on a rotation of said cam, having an end face cooperating with an inner peripheral surface of said cylindrical bore to define a pumping chamber, disposed such that at a first position of said cam, said plunger is in a first position where said supply opening is in communication with said pumping chamber, and at a second position of said cam, when said plunger is in a second position where said supply opening is out of communication with said pumping chamber and a size of said pumping chamber is minimum, and pressurizing the fuel in said pumping chamber in a forward stroking movement thereof which is a direction that said plunger travels from said first position to said second position; and valve means, located in said low pressure passage opening, including a valve member for opening and closing said low pressure passage opening, to selectively communicate said pressure chamber with said low pressure fuel supply, said valve member being completely closed at a point during between said first and second positions of said plunger to define a timing of beginning pressurizing the fuel in said pumping chamber;

wherein the discharge of fuel into said common rail from said pressure chamber is finished only at an end of said forward stroking movement of said plunger when said cam and said plunger are both in respective second positions.

18. A pump as in claim 17, wherein said valve member opens outwardly from said solenoid valve when said solenoid valve is deenergized to communicate said pressure chamber with said low pressure fuel supply, and is closed during said forward stroking movement of said plunger when said solenoid valve is energized, to define a timing of pressuring the fuel in said pumping chamber, and said valve member being disposed to receive from the pressurized fuel in said pumping chamber a force which urges said valve member toward the closed position when said valve member is closed.

19. A high pressure pump according to claim 17 wherein said cam has a cam profile so shaped that a speed of movement of said plunger is low in an initial stage of a forward stroking movement of said plunger and is high in a late stage of the forward stroking movement of said plunger.

20. A high pressure pump according to claim 1, wherein said valve means includes ECU means for commanding said communicating to close at a time during said forward stroking movement calculated so that a proper amount of fuel will be injected into said common rail by said end of said forward stroking movement.

21. A high pressure pump according to claim 7, further comprising ECU means for energizing said valve member to close at a time during said forward stroking movement calculated so that a proper amount of fuel will be injected into said common rail by said end of said forward stroking movement.

22. A high pressure pump according to claim 17, further comprising ECU means for energizing said valve means to close at a time during said forward stroking movement calculated so that a proper amount of fuel will be injected into said common rail by said end of said forward stroking movement.

* * * * *